US011078906B2

(12) United States Patent
Sato et al.

(10) Patent No.: US 11,078,906 B2
(45) Date of Patent: Aug. 3, 2021

(54) SCROLL FLUID MACHINE HAVING A DIFFERENT MESH CLEARANCE BETWEEN THE FIXED AND ORBITING SCROLL WRAPS

(71) Applicant: MITSUBISHI HEAVY INDUSTRIES THERMAL SYSTEMS, LTD., Tokyo (JP)

(72) Inventors: Hajime Sato, Tokyo (JP); Yoshiyuki Kimata, Tokyo (JP); Yohei Hotta, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 86 days.

(21) Appl. No.: 16/093,753

(22) PCT Filed: Aug. 14, 2017

(86) PCT No.: PCT/JP2017/029241
§ 371 (c)(1),
(2) Date: Oct. 15, 2018

(87) PCT Pub. No.: WO2018/034254
PCT Pub. Date: Feb. 22, 2018

(65) Prior Publication Data

US 2019/0120230 A1 Apr. 25, 2019

(30) Foreign Application Priority Data

Aug. 19, 2016 (JP) ..... JP2016-161209

(51) Int. Cl.
*F01C 1/02* (2006.01)
*F03C 2/00* (2006.01)
(Continued)

(52) U.S. Cl.
CPC ..... *F04C 18/0215* (2013.01); *F01C 1/0215* (2013.01); *F04C 18/0269* (2013.01);
(Continued)

(58) Field of Classification Search
CPC ..... F04C 18/0215; F04C 18/0246; F04C 18/0269; F04C 18/0276; F04C 18/0284;
(Continued)

(56) References Cited

U.S. PATENT DOCUMENTS 4,477,238 A 10/1984 Terauchi
5,496,161 A 3/1996 Machida et al.
(Continued)

FOREIGN PATENT DOCUMENTS

CN 102052302 A 5/2011
EP 2527655 A1 11/2012
(Continued)

OTHER PUBLICATIONS

Extended European Search Report, dated May 13, 2019, for European Application No. 17841496.7.
(Continued)

*Primary Examiner* — Theresa Trieu
(74) *Attorney, Agent, or Firm* — Birch, Stewart, Kolasch h& Birch, LLP.

(57) ABSTRACT

A scroll fluid machine that attenuates the bending stress applied to the base of a wall body having an inclined section. The scroll fluid machine is provided with a wall body inclined section in which the distance between the facing surfaces of an end plate of a fixed scroll and an end plate of a rotating scroll that face each other continuously decreases from the outer circumferential side toward the inner circumferential side. A mesh clearance that is a gap between wall bodies formed when the wall bodies mesh with each other is larger on the outer circumferential side of the inclined
(Continued)

section than on the inner circumferential side of the inclined section. The mesh clearance is made larger by drawing the wall surface of a wall body further back toward the central side of the wall body in the thickness direction than the original wall surface profile thereof.

9 Claims, 11 Drawing Sheets

(51) Int. Cl.

| | |
|---|---|
| ***F03C 4/00*** | (2006.01) |
| ***F04C 18/00*** | (2006.01) |
| ***F04C 18/02*** | (2006.01) |
| ***F04C 27/00*** | (2006.01) |
| *F04C 29/00* | (2006.01) |

(52) U.S. Cl.
CPC ..... *F04C 18/0276* (2013.01); *F04C 27/00* (2013.01); *F04C 27/001* (2013.01); *F04C 29/0028* (2013.01); *F04C 2210/26* (2013.01); *F04C 2230/602* (2013.01); *F04C 2240/20* (2013.01); *F04C 2270/04* (2013.01); *F04C 2270/17* (2013.01)

(58) Field of Classification Search
CPC ..... F04C 27/00; F04C 27/001; F04C 27/005; F04C 27/007; F04C 29/0028; F04C 2210/26; F04C 2230/602; F04C 2240/20; F04C 2270/17; F01C 1/0215; F01C 1/0246; F01C 1/0269; F01C 1/0276; F01C 1/0284; F01C 19/08; F01C 19/10
See application file for complete search history.

(56) References Cited

U.S. PATENT DOCUMENTS

| | | | | |
|---|---|---|---|---|
| 6,050,792 | A | 4/2000 | Shaffer | |
| 6,746,224 | B2 | 6/2004 | Itoh et al. | |
| 8,157,550 | B2 | 4/2012 | Kudo | |
| 2002/0054821 | A1 | 5/2002 | Takeuchi et al. | |
| 2009/0208356 | A1* | 8/2009 | Ginies | F04C 18/0276 418/55.2 |
| 2010/0092318 | A1 | 4/2010 | Sato et al. | |
| 2012/0288394 | A1 | 11/2012 | Murakami et al. | |
| 2012/0315173 | A1 | 12/2012 | Nakamura et al. | |
| 2014/0308146 | A1 | 10/2014 | Hirata et al. | |
| 2017/0370219 | A1* | 12/2017 | Takeuchi | F04C 18/0276 418/55.2 |

FOREIGN PATENT DOCUMENTS

| | | | |
|---|---|---|---|
| EP | 2538083 | A1 | 12/2012 |
| EP | 2894338 | A1 | 7/2015 |
| JP | 7-35061 | A | 2/1995 |
| JP | 11-190287 | A | 7/1999 |
| JP | 2001-12365 | A | 1/2001 |
| JP | 2002-70766 | A | 3/2002 |
| JP | 2006-342776 | A | 12/2006 |
| JP | 2008-133778 | A | 6/2008 |
| JP | 2008-163895 | A | 7/2008 |
| JP | 2009-228476 | A | 10/2009 |
| JP | 2010-196663 | A | 9/2010 |
| JP | 2012-36825 | A | 2/2012 |
| JP | 2014-80940 | A | 5/2014 |
| JP | 2015-55173 | A | 3/2015 |
| JP | 2016-102486 | A | 6/2016 |

OTHER PUBLICATIONS

Extended European Search Report, dated May 31, 2019, for European Application No. 17841476.9.
Written Opinion of the International Searching Authority and International Search Report, dated Oct. 17, 2017, for International Application No. PCT/JP2017/029327, with English translations.
Written Opinion of the International Searching Authority and International Search Report, dated Oct. 24, 2017, for International Application No. PCT/JP2017/029241, with English translations.
Written Opinion of the International Searching Authority and International Search Report, dated Oct. 31, 2017, for International Application No. PCT/JP2017/029243, with English translations.
U.S. Office Action dated Aug. 7, 2020 for U.S. Appl. No. 16/090,725.
U.S. Office Action dated Sep. 15, 2020 for U.S. Appl. No. 16/097,749.

* cited by examiner

SCROLL FLUID MACHINE HAVING A DIFFERENT MESH CLEARANCE BETWEEN THE FIXED AND ORBITING SCROLL WRAPS

TECHNICAL FIELD

The present invention relates to a scroll fluid machine.

BACKGROUND ART

In general, a scroll fluid machine is known, in which a fixed scroll member and an orbiting scroll member each having a spiral wall provided on an end plate mesh with each other so as to perform a revolution orbiting movement and a fluid is compressed or expanded.

As the scroll fluid machine, a so-called stepped scroll compressor which is described in PTL 1 is known. In the stepped scroll compressor, step portions are provided at positions of tooth tip surfaces and tooth bottom surfaces of spiral walls of a fixed scroll and an orbiting scroll in a spiral direction and a height on an outer peripheral side of each wall is higher than a height on an inner peripheral side thereof with each step portion as a boundary. The stepped scroll compressor is compressed (three-dimensionally compressed) not only in a circumferential direction of the wall but also in a height direction thereof, and thus, compared to a general scroll compressor (two-dimensional compression) which does not have the step portion, an amount of displacement increases, and thus, compressor capacity can increase.

CITATION LIST

Patent Literature

[PTL 1] Japanese Unexamined Patent Application Publication No. 2015-55173

SUMMARY OF INVENTION

Technical Problem

However, in the stepped scroll compressor, there is a problem that fluid leakage in the step portion is large. In addition, there is a problem that stress concentrates on a base of the step portion and strength decreases.

Meanwhile, the inventors are studying to provide a continuously inclined portion instead of the step portion provided on the wall and the end plate.

However, if the inclined portion is provided and a height of the wall is changed, at a position at which the height of the wall is high, at the time of a tooth surface contact in which the walls come into contact with each other in order to form a compression chamber, a large moment is applied to a periphery of the base of the wall. If the large moment is applied to the periphery of the base of the wall, there is a concern that bending stress increases and the wall is damaged.

The present invention is made in consideration of the above-described circumstances, and an object thereof is to provide a scroll fluid machine capable of alleviating the bending stress applied to the base of the wall having the inclined portion.

Solution to Problem

In order to achieve the above-described objects, a scroll fluid machine of the present invention adopts the following means.

That is, according to an aspect of the present invention, there is provided a scroll fluid machine including: a first scroll member in which a spiral first wall is provided on a first end plate; a second scroll member in which a spiral second wall is provided on a second end plate disposed to face the first end plate and the second wall meshes with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, in which for a mesh clearance which is a clearance between the walls when the first wall and the second wall mesh with each other, the mesh clearance on the outer peripheral side of the inclined portion is larger than the mesh clearance on the inner peripheral side of the inclined portion.

The inclined portion is provided in which the inter-facing surface distance between the first end plate and the second end plate continuously decreases from outer peripheral side of the wall toward inner peripheral side thereof. Accordingly, as a fluid sucked from the outer peripheral side flows toward the inner peripheral side, the fluid not only is compressed by a decrease of a compression chamber according to a spiral shape of the wall but also is further compressed by a decrease of the inter-facing surface distance between the end plates.

When the walls mesh with each other, a moment is applied to a periphery of the base of the wall by a load applied at the time of a tooth surface contact in which the walls come into contact with each other. The moment in the periphery of the base of the wall increases as a height of the wall increases. In addition, in a range of the inclined portion, the height of the wall on the outer peripheral side is higher than that of the wall on the inner peripheral side. Accordingly, in the mesh clearance which is the clearance between the walls when the walls mesh with each other, the mesh clearance on the outer peripheral side is set to be larger than that on the inner peripheral side. Therefore, it is possible to alleviate the moment applied to the periphery of the base of the wall on the outer peripheral side having a high wall height, and thus, bending stress can decrease.

In addition, even when the mesh clearance on the outer peripheral side is large, a pressure in the compression chamber on the outer peripheral side is lower than that on the inner peripheral side, and thus, influences of fluid leakage on performance decreases. Preferably, the mesh clearance on the outer peripheral side is set to such a degree that influences on performance can be ignored. For example, the mesh clearance on the outer peripheral side is 100 μm or less.

In addition, the scroll fluid machine of the present invention, the mesh clearance continuously or stepwise increases from the inner peripheral side of the inclined portion to the outer peripheral side thereof.

The mesh clearance continuously or stepwise increases from the inner peripheral side to the outer peripheral side of the inclined portion, and thus, it is possible to set the mesh clearance according to the wall height of the inclined portion. Accordingly, it is possible to suppress the bending stress generated in the base of the wall to a predetermined value or less.

Here, the "continuous" means that the mesh clearance is differentially changeable in the spiral direction of the wall, and the "stepwise" means that the mesh clearance is changed with a predetermined position as a boundary.

In addition, in the scroll fluid machine according to the aspect of the present invention, the mesh clearance on the inner peripheral side of the inclined portion is an original mesh clearance where the walls mesh with each other.

With respect to the inner peripheral side of the inclined portion, the mesh clearance in which meshing with small fluid leakage is performed may be set to the original mesh clearance where the walls mesh with each other. Meanwhile, as described above, the mesh clearance increases to alleviate the tooth surface contact between the walls on the outer peripheral side of the inclined portion. Accordingly, it is possible to alleviate the bending stress due to the moment applied to the base of the wall on the outer peripheral side while increasing compression performance on the inner peripheral side.

The "original mesh clearance where the walls mesh with each other" is a clearance which allows the tooth surface contact when the walls mesh with each other, and for example, is 0 μm to 20 μm.

In addition, in the scroll fluid machine according to the aspect of the present invention, a wall flat portion having a height which is not changed is provided on outermost peripheral portions and/or innermost peripheral portions of the first wall and the second wall, an end plate flat portion corresponding to the wall flat portion is provided on the first end plate and the second end plate, and the mesh clearance in a wall inclined connection portion which connects the wall flat portion and the inclined portion to each other is larger than the mesh clearance provided in the inclined portion and the wall flat portion.

The wall inclined connection portion which connects the wall flat portion and the inclined portion to each other is positioned at a position at which the shape is abruptly changed, and thus, it is difficult to increase processing accuracy, and there is a concern that a burr or the like occurs. Accordingly, there is a concern that an excessive tooth surface contact occurs in the wall inclined connection portion. Accordingly, the mesh clearance of the wall inclined connection portion is larger than the mesh clearance of the inclined portion or the wall flat portion. Therefore, it is possible to avoid the excessive tooth surface contact in the wall inclined connection portion.

In addition, in the scroll fluid machine according to the aspect of the present invention, the meshing clearance is increased by retreating a wall surface of the wall toward a center side in a thickness of the wall from an original wall surface profile.

By retreating the wall surface toward the center side in the thickness of the wall from the original wall surface profile of the wall, the mesh clearance is increased. That is, the wall becomes thinner in the region where the mesh clearance is larger. Accordingly, the mesh clearance is easily set when design is performed.

The "original wall surface profile" means a wall surface shape which allows the tooth surface contact when the walls mesh with each other.

Advantageous Effects of Invention

In the mesh clearance which is the clearance between the walls when the walls mesh with each other, the mesh clearance on the outer peripheral side is larger than that on the inner peripheral side, and thus, it is possible to alleviate the moment applied to the periphery of the base of the wall on the outer peripheral side of the inclined portion having a high wall height, and thus, the bending stress can decrease.

BRIEF DESCRIPTION OF DRAWINGS

FIG. 1A is a longitudinal section view, and FIG. 1B is a plan view when the fixed scroll is viewed from a wall side.

FIG. 7A is a side view showing a state where the tip seal clearance relatively decreases, and FIG. 7B is a side view showing a state where the tip seal clearance relatively increases.

FIG. 9A is a longitudinal section view showing a combination with a scroll which does not have a step portion, and FIG. 9B is a longitudinal section view showing a combination with a stepped scroll.

DESCRIPTION OF EMBODIMENTS

First Embodiment

Hereinafter, a first embodiment according to the present invention will be described with reference to the drawings.

Figure 1A:
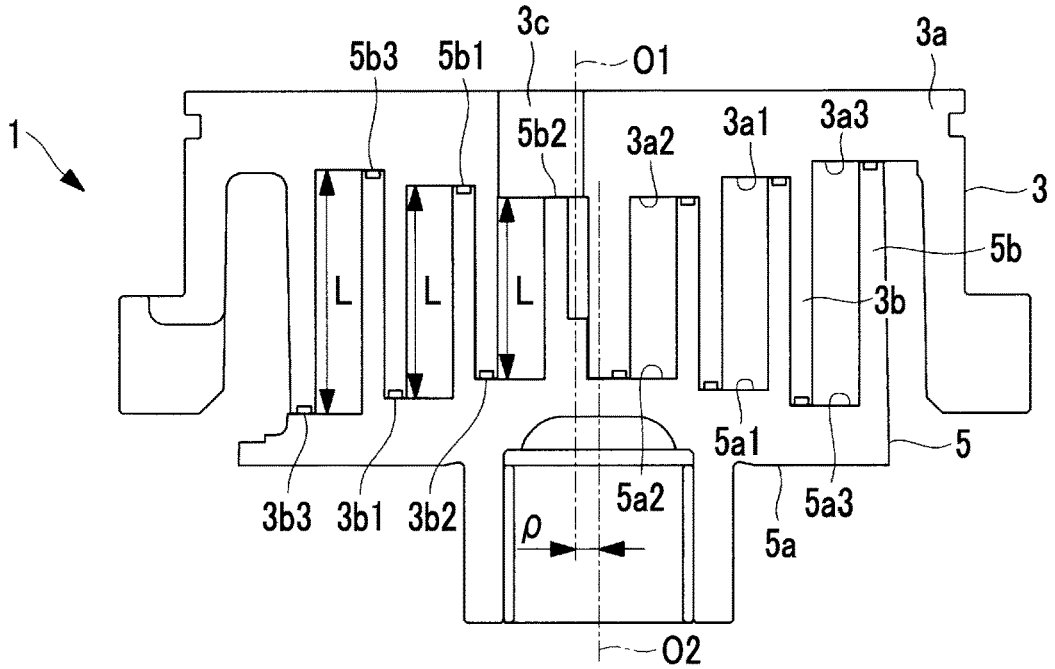
FIGS. 1A and 1B show a fixed scroll and an orbiting scroll of a scroll compressor according to an embodiment of the present invention.
Figure 1B:
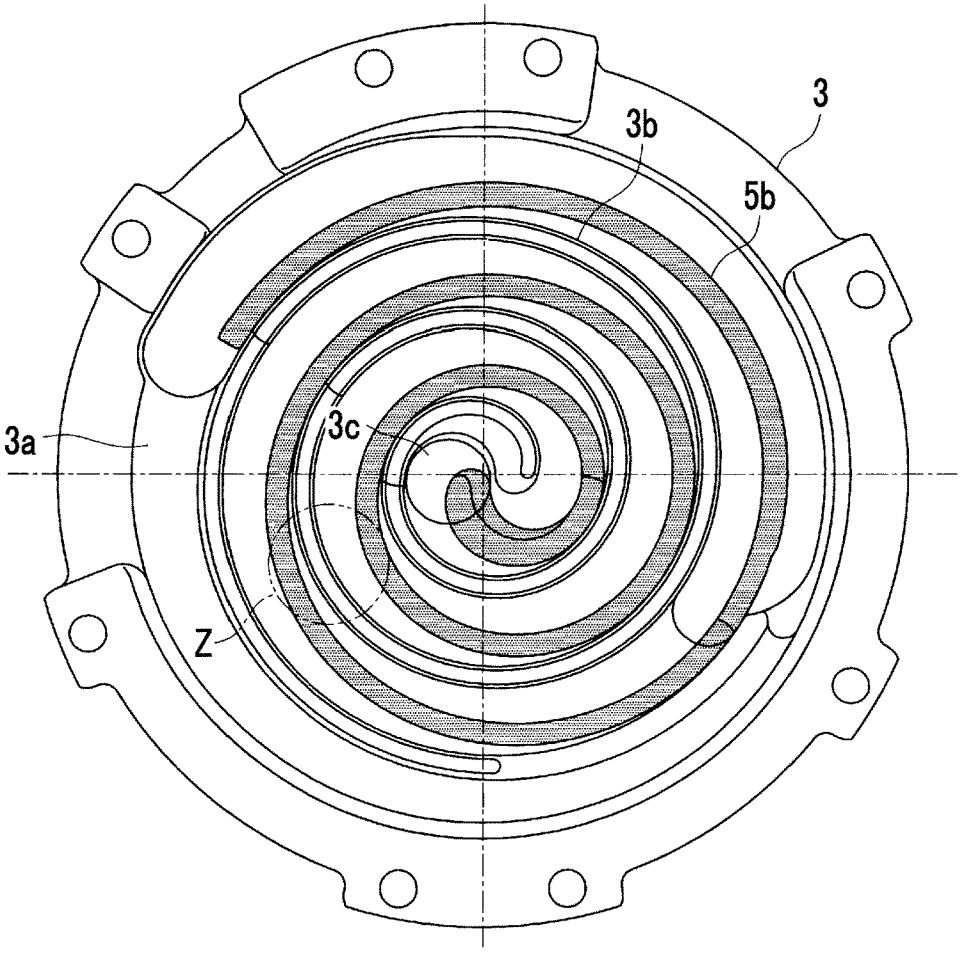

In FIGS. 1A and 1B, a fixed scroll (first scroll member) 3 and an orbiting scroll (second scroll member) 5 of a scroll compressor (scroll fluid machine) 1 are shown. For example, the scroll compressor 1 is used as a compressor which compresses a gas refrigerant (fluid) which performs a refrigerating cycle of an air conditioner or the like.

Each of the fixed scroll 3 and the orbiting scroll 5 is a metal compression mechanism which is formed of an aluminum alloy or steel, and is accommodated in a housing (not shown). The fixed scroll 3 and the orbiting scroll 5 suck a fluid, which is introduced into the housing, from an outer peripheral side, and discharge the compressed fluid from a discharge port 3*c* positioned at a center of the fixed scroll 3 to the outside.

The fixed scroll 3 is fixed to the housing, and as shown in FIG. 1A, includes an approximately disk-shaped end plate (first end plate) 3*a*, and a spiral wall (first wall) 3*b* which is erected on one side surface of the end plate 3*a*. The orbiting scroll 5 includes an approximately disk-shaped end plate (second end plate) 5*a* and a spiral wall (second wall) 5*b* which is erected on one side surface of the end plate 5*a*. For example, a spiral shape of each of the walls 3*b* and 5*b* is defined by using an involute curve or an Archimedes curve.

The fixed scroll 3 and the orbiting scroll 5 are assembled to each other such that centers thereof are separated from each other by an orbiting radius ρ, the walls 3*b* and 5*b* mesh with each other with phases deviated from each other by 180°, and a slight clearance (tip clearance) in a height direction is provided between tooth tips and tooth bottoms of the walls 3*b* and 5*b* of both scrolls. Accordingly, a plurality pairs of compression chambers which are formed to be surrounded by the end plates 3*a* and 5*a* and the walls 3*b* and 5*b* are symmetrically formed about a scroll center between both scrolls 3 and 5. The orbiting scroll 5 performs a revolution orbiting movement around the fixed scroll 3 by a rotation prevention mechanism such as an Oldham ring (not shown).

As shown in FIG. 1A, an inclined portion is provided, in which an inter-facing surface distance L between both end plates 3*a* and 5*a* facing each other continuously decrease from an outer peripheral side of each of the spiral walls 3*b* and 5*b* toward an inner peripheral side thereof.

Figure 2:
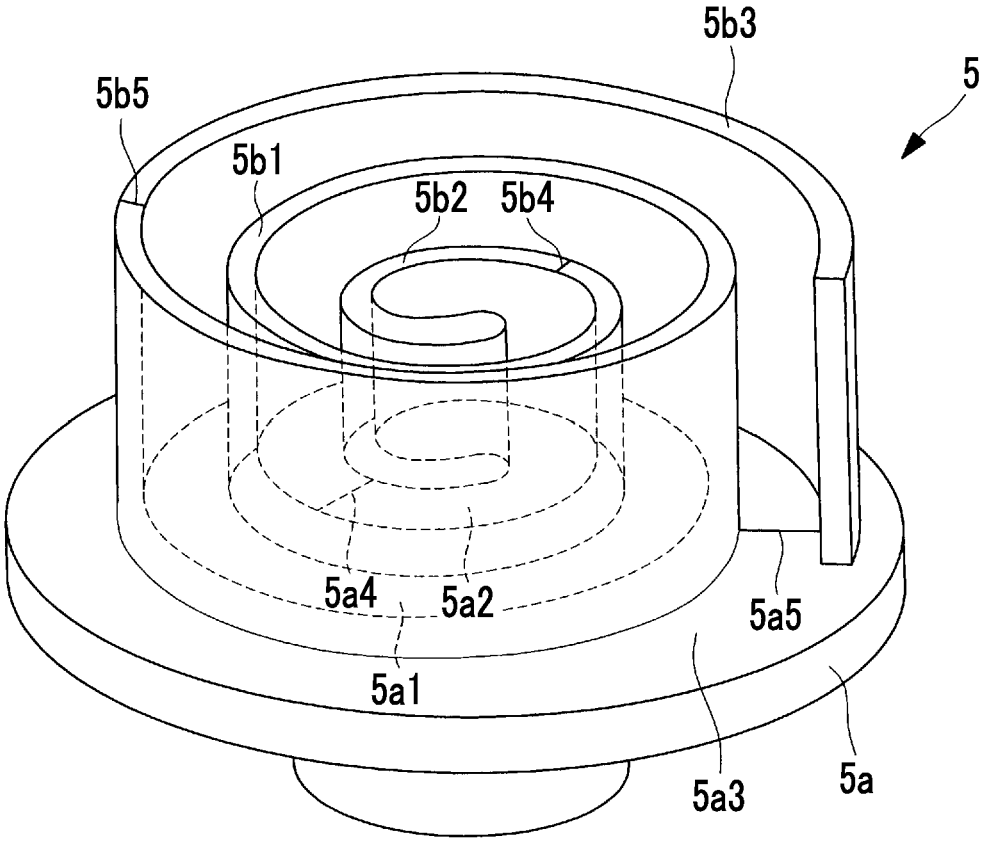
FIG. 2 is a perspective view showing the orbiting scroll of FIGS. 1A and 1B.

As shown in FIG. 2, in the wall 5*b* of the orbiting scroll 5, a wall inclined portion 5*b*1 whose height continuously decreases from an outer peripheral side toward an inner peripheral side is provided. In a tooth bottom surface of the fixed scroll 3 facing a tooth tip of the wall inclined portion 5*b*1, an end plate inclined portion 3*a*1 (refer to FIG. 1A) which is inclined according to an inclination of the wall inclined portion 5*b*1 is provided. A continuously inclined portion is formed by the wall inclined portion 5*b*1 and the end plate inclined portion 3*a*1. Similarly, a wall inclined portion 3*b*1 whose height is continuously inclined from the outer peripheral side toward the inner peripheral side is provided on the wall 3*b* of the fixed scroll 3, and an end plate inclined portion 5*a*1 facing a tooth tip of the wall inclined portion 3*b*1 is provided on the end plate 5*a* of the orbiting scroll 5.

In addition, the meaning of the continuity in the inclined portion in the present embodiment is not limited to a smoothly connected inclination but also includes an inclined portion in which small steps inevitably generated during processing are connected to each other in a stepwise fashion and the inclined portion is continuously inclined as a whole. However, the inclined portion does not include a large step portion such as a so-called stepped scroll.

Coating is applied to the wall inclined portions 3*b*1 and 5*b*1 and/or the end plate inclined portions 3*a*1 and 5*a*1. For example, the coating includes manganese phosphate processing, nickel phosphorus plating, or the like.

As shown in FIG. 2, wall flat portions 5*b*2 and 5*b*3 each having a constant height are respectively provided on the innermost peripheral side and the outermost peripheral side of the wall 5*b* of the orbiting scroll 5. Each of the wall flat portions 5*b*2 and 5*b*3 is provided over a region of 180° around a center O2 (refer to FIG. 1A) of the orbiting scroll 5. Wall inclined connection portions 5*b*4 and 5*b*5 which become curved portions are respectively provided at positions at which the wall flat portions 5*b*2 and 5*b*3 and the wall inclined portion 5*b*1 are connected to each other.

Similarly, in the tooth bottom of the end plate 5*a* of the orbiting scroll 5, end plate flat portions 5*a*2 and 5*a*3 each having a constant height are provided. Each of the end plate flat portions 5*a*2 and 5*a*3 is provided over a region of 180° around the center of the orbiting scroll 5. End plate inclined connection portions 5*a*4 and 5*a*5 which become curved portions are respectively provided at positions at which the end plate flat portions 5*a*2 and 5*a*3 and the end plate inclined portion 5*a*1 are connected to each other.

Figure 3:
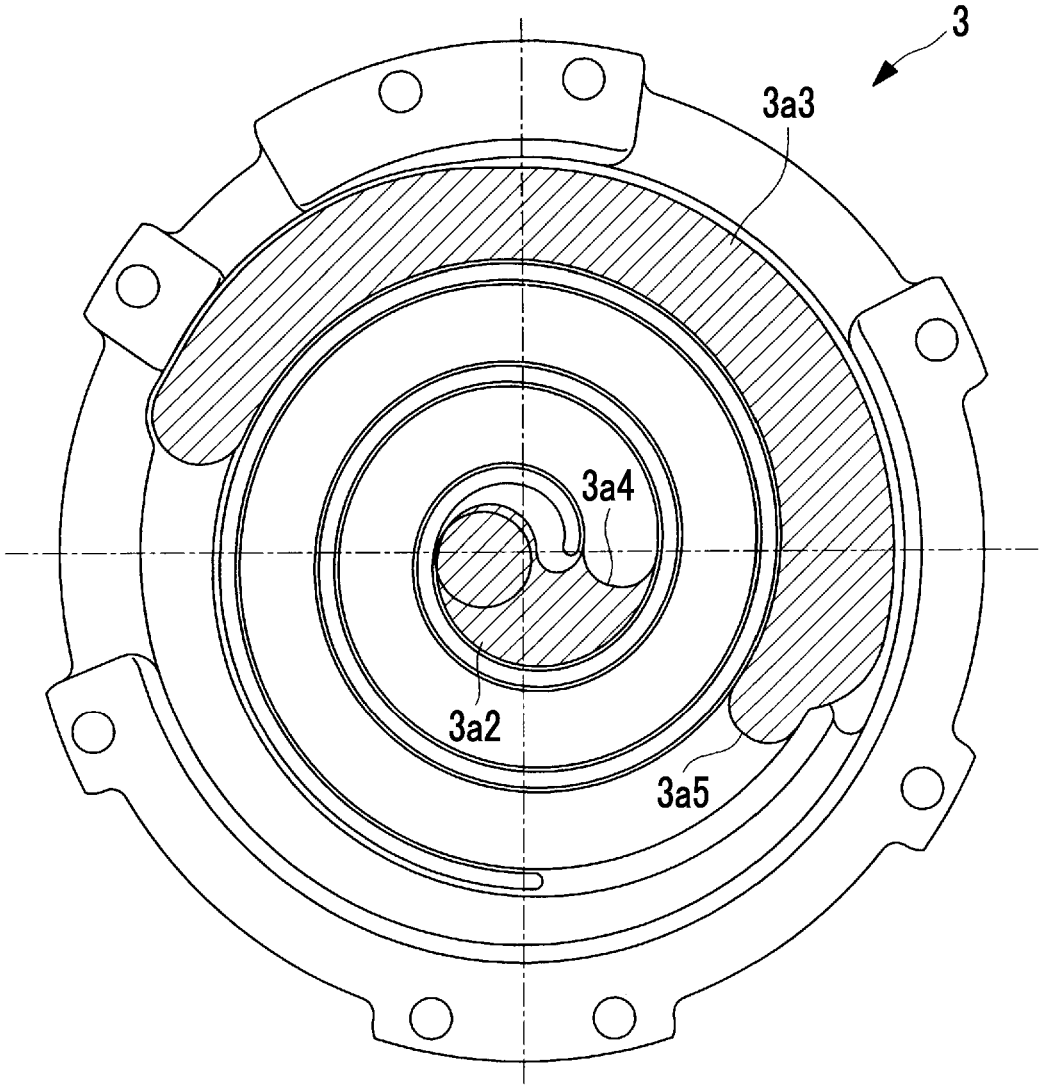
FIG. 3 is a plan view showing an end plate flat portion provided in the fixed scroll.
Figure 4:
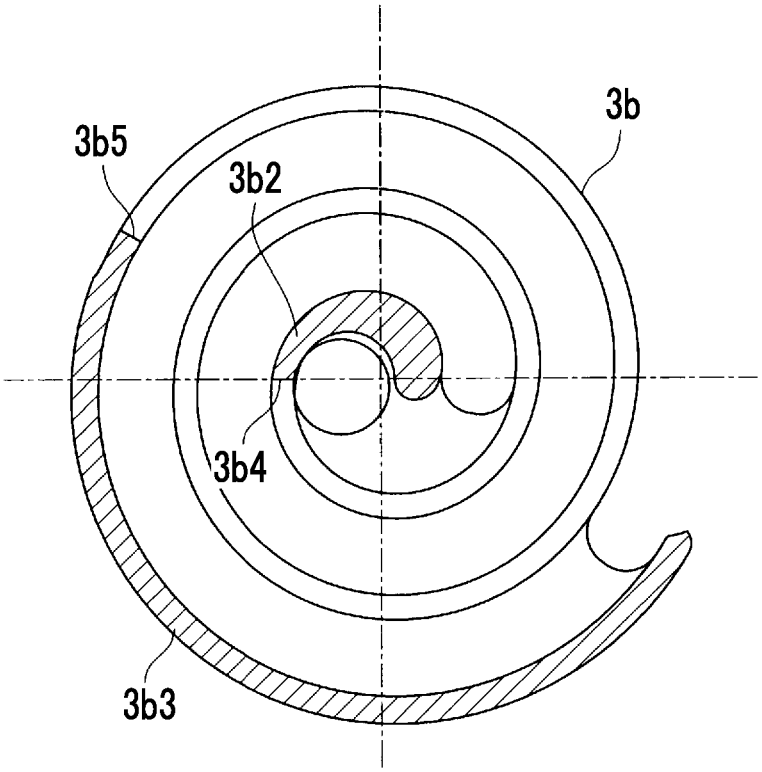
FIG. 4 is a plan view showing a wall flat portion provided in the fixed scroll.

As shown by hatching in FIGS. 3 and 4, similarly to the orbiting scroll 5, in the fixed scroll 3, end plate flat portions 3*a*2 and 3*a*3, wall flat portions 3*b*2 and 3*b*3, end plate inclined connection portions 3*a*4 and 3*a*5, and wall inclined connection portions 3*b*4 and 3*b*5 are provided.

Figure 5:
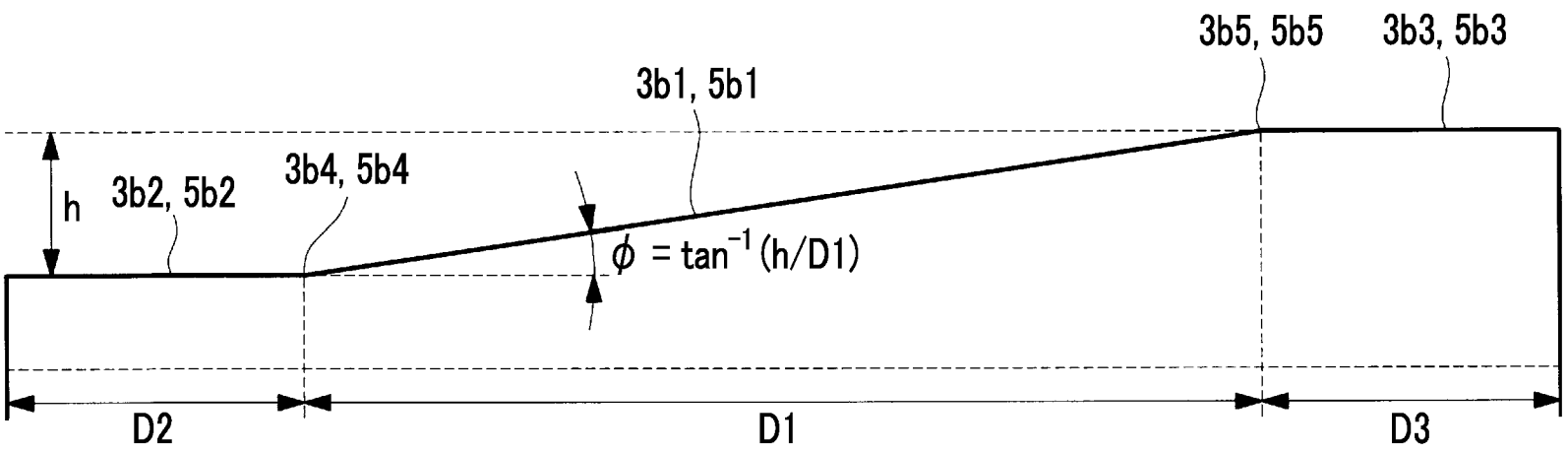
FIG. 5 is a schematic view showing a wall which is displayed to extend in a spiral direction.

FIG. 5 is a schematic view showing the walls 3*b* and 5*b* which are displayed to extend in a spiral direction. As shown in FIG. 5, the wall flat portions 3*b*2 and 5*b*2 on the innermost peripheral side are provided over a distance D2, and the wall flat portions 3*b*3 and 5*b*3 on the outermost peripheral side are provided over a distance D3. Each of the distance D2 and the distance D3 is a length corresponding to the region which becomes 180° around each of the centers O1 and O2 of the respective scrolls 3 and 5. The wall inclined portions 3*b*1 and 5*b*1 are provided over the distance D1 between the wall flat portions 3*b*2 and 5*b*2 on the innermost peripheral side and the wall flat portions 3*b*3 and 5*b*3 on the outermost peripheral side. If a height difference between each of the wall flat portions 3*b*2 and 5*b*2 on the innermost peripheral side and each of the wall flat portions 3*b*3 and 5*b*3 on the outermost peripheral side is defined as h, an inclination of each of the wall inclined portions 3*b*1 and 5*b*1 is represented by the following Expression.

$$\varphi=\tan^{-1}(h/D1) \quad (1)$$

In this way, the inclination φ of the inclined portion is constant in a circumferential direction in which each of the spiral walls 3*b* and 5*b* extends.

Figure 10:
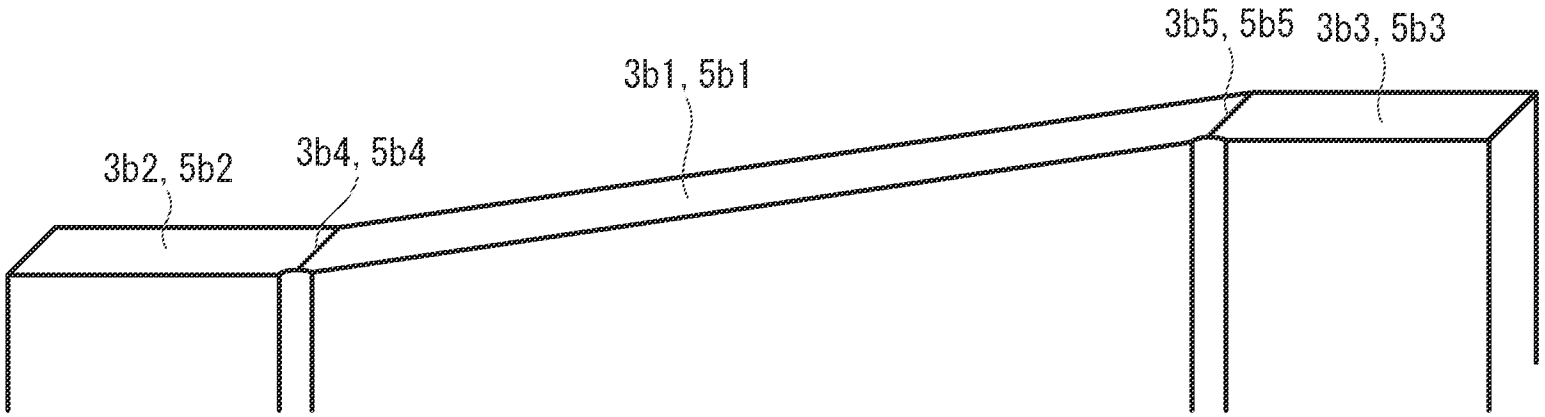
FIG. 10 is a perspective view of FIG. 5.
Figure 11:
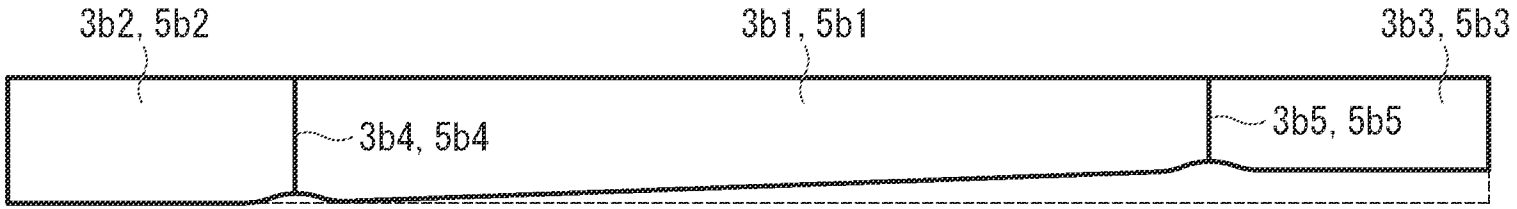
FIG. 11 is a plan view of FIG. 5.

FIG. 10 is a perspective view of FIG. 5 and FIG. 11 is a plan view of FIG. 5.

Figure 6:
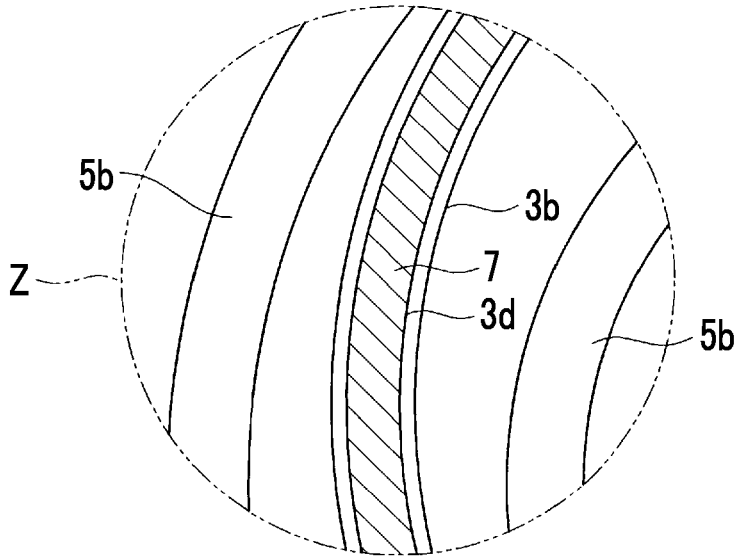
FIG. 6 is a partially enlarged view showing a region indicated by a reference numeral Z in FIG. 1B in an enlarged manner.

FIG. 6 is a partially enlarged view showing a region indicated by a reference numeral Z in FIG. 1B in an enlarged manner. As shown FIG. 6, a tip seal is provided in the tooth tip of the wall 3*b* of the fixed scroll 3. The tip seal 7 is formed of a resin and comes into contact with the tooth bottom of the end plate 5*a* of the facing orbiting scroll 5 so as to seal a fluid. The tip seal 7 is accommodated in a tip seal groove 3*d* which is formed on the tooth tip of the wall 3*b* in the circumferential direction. A compressed fluid enters the tip seal groove 3*d*, presses the tip seal 7 from a rear surface thereof to push the tip seal 7 toward the tooth bottom side, and thus, the tip seal 7 comes into contact with the facing the tooth bottom. In addition, a tip seal is also provided in the tooth tip of the wall 5*b* of the orbiting scroll 5.

Figure 7A:
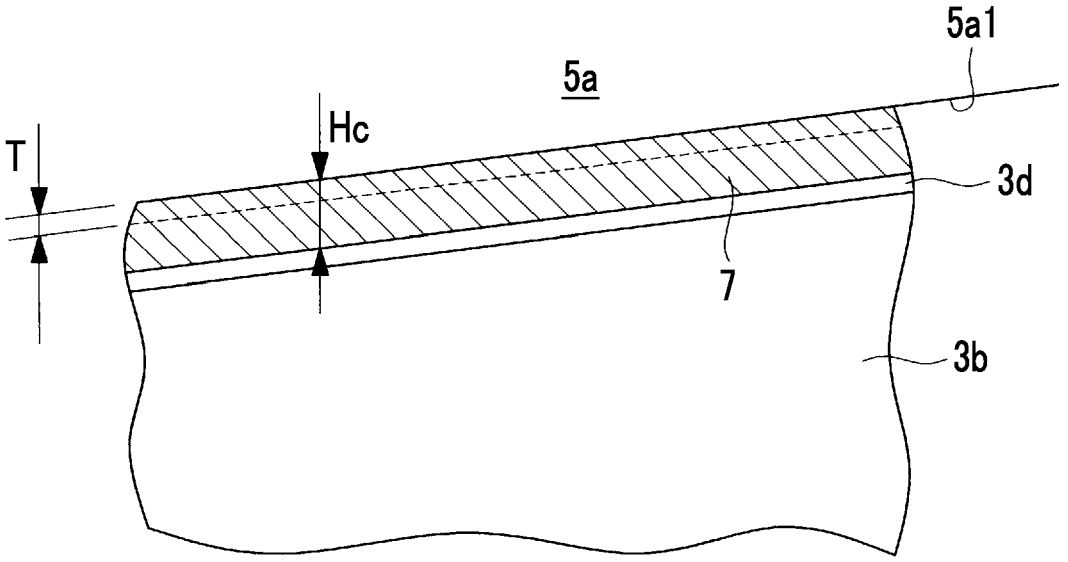
FIGS. 7A and 7B show a tip seal clearance of a portion shown in FIG. 6.
Figure 7B:
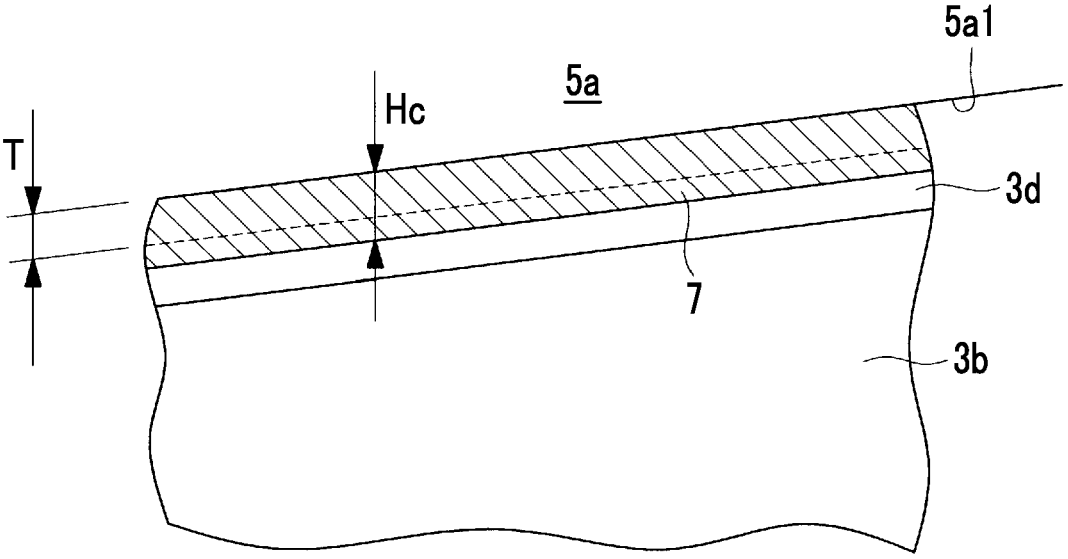

As shown in FIGS. 7A and 7B, a height Hc of the tip seal 7 in the height direction of the wall 3*b* is constant in the circumferential direction.

If both the scrolls 3 and 5 perform the revolution orbiting movement relative to each other, the positions of the tooth tip and the tooth bottom are relatively deviated by an orbiting radius (orbiting radius ρ×2). In the inclined portion, the tip clearance between the tooth tip and the tooth bottom is changed due to the positional deviation between the tooth tip and the tooth bottom. For example, in FIG. 7A, a tip clearance T decreases, and in FIG. 7B, the tip clearance T increases. Even when the tip clearance T is changed by an orbiting movement, the tip seal 7 is pressed toward the tooth bottom side of the end plate 5*a* by the compressed fluid from the rear surface, and the tip seal 7 can follow the tooth bottom so as to seal the tooth bottom.

Next, setting of a mesh clearance which is a clearance between the walls 3*b* and 5*b* when the walls 3*b* and 5*b* mesh with each other will be described using FIG. 8.

Figure 8:
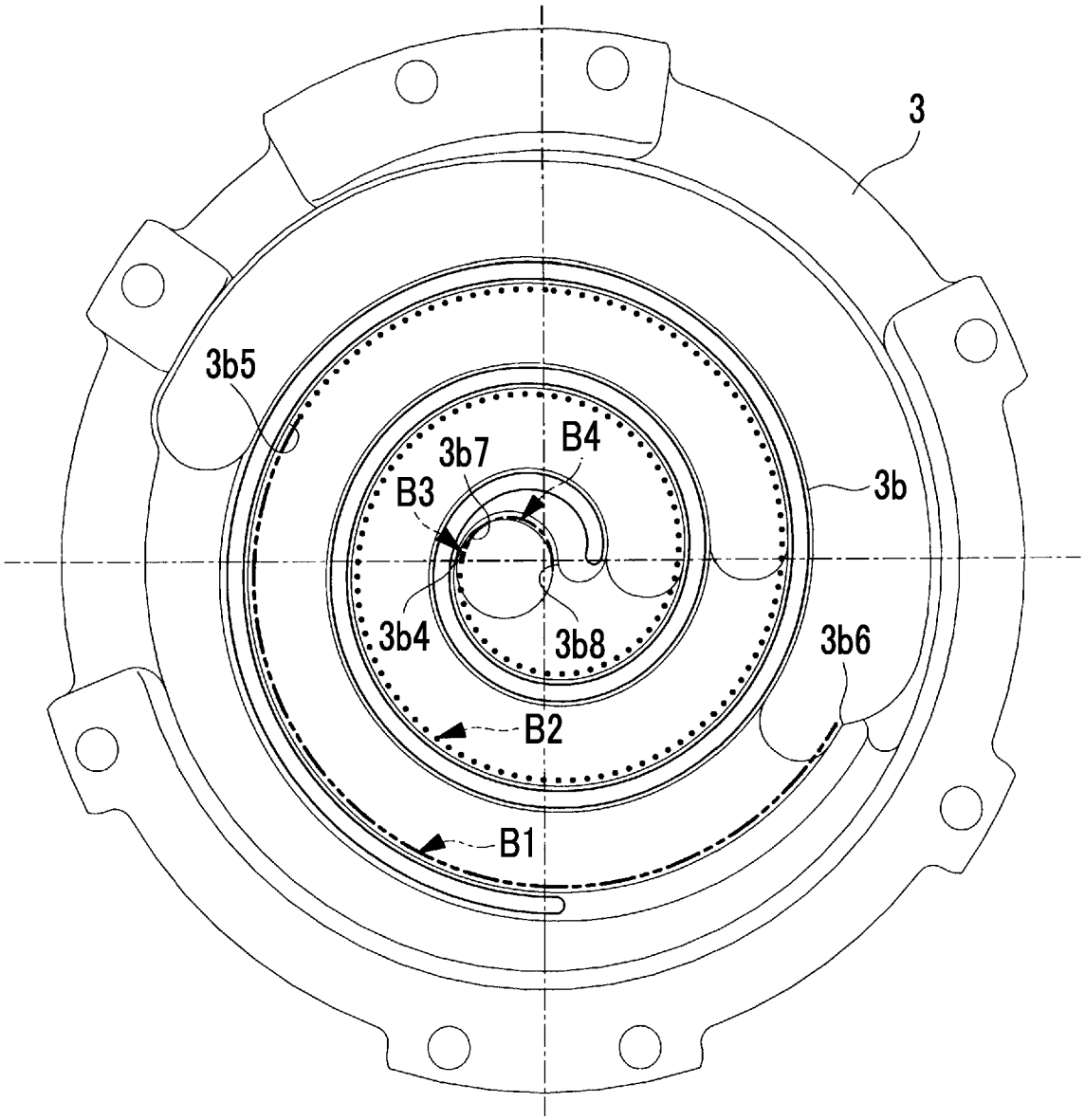
FIG. 8 is a plan view showing a retreated portion provided in the fixed scroll.

FIG. 8 shows a plan view of the fixed scroll 3. A retreated portion which adjusts the mesh clearance is provided on a ventral side (inner peripheral surface side) of the wall 3*b*. The retreated portion is a region which is retreated toward a center side in a thickness of the wall 3*b* from an original wall surface profile of a ventral-side surface of the wall 3*b*.

Accordingly, the thickness (tooth thickness) of the wall 3*b* in the retreated portion is thinner than those of other regions. In addition, the "original wall surface profile" means a wall surface shape which allows a tooth surface contact when the walls 3*b* and 5*b* mesh with each other.

A first retreated portion B1 is provided in a region between an outer peripheral end portion 3*b*6 of the wall 3*b* in the spiral direction and the wall inclined connection portion 3*b*5 which is positioned to advance from the outer peripheral end portion 3*b*6 toward the inner peripheral side in the spiral direction by 180°, that is, a region (a region indicated by a two-dot chain line) corresponding to the wall flat portion 3*b*3 on the outer peripheral side. The first retreated portion B1 becomes an inner peripheral surface which is retreated from the original wall surface profile toward the center side in the thickness of the wall 3*b* by a predetermined amount. In the following descriptions, an amount which is retreated from the original wall surface profile toward the center side in the thickness of the wall, that is, an amount which is retreated in a direction orthogonal to the wall surface is referred to as a "wall surface retreat amount". The wall surface retreat amount of the first retreated portion B1 is constant in the spiral direction. The wall surface retreat amount of the first retreated portion B1 is preferably set to such a degree that a decrease in compression performance due to fluid leakage can be ignored, for example, set to 100 μm.

A second retreated portion B2 is provided in a region from the wall inclined connection portion 3*b*5 to the wall inclined connection portion 3*b*4 on the inner peripheral side, that is, a region (a region indicated by a dotted line) corresponding to the wall inclined portion 3*b*1. The wall surface retreat amount of the second retreated portion B2 is equal to or less than the wall surface retreat amount of the first retreated portion B1, and The wall surface retreat amount of the second retreated portion B2 continuously or stepwise increases from the inner peripheral side toward the outer peripheral side. Here, the "continuous" means that the retreat amount is differentially changeable in the spiral direction, which means that the retreat amount is monotonically changed, for example. The "stepwise" means that the wall surface retreat amount is changed with a predetermined position as a boundary.

A third retreated portion B3 is provided in a region from the wall inclined connection portion 3*b*4 on the inner peripheral side to an involute starting point 3*b*7 which becomes a starting point of the shape of the wall 3*b* on the inner peripheral side based on an involute curve, that is, a region which constitutes a portion of the wall flat portion 3*b*2 on the inner peripheral side. The wall surface retreat amount of the third retreated portion is equal to or less than the wall surface retreat amount in the innermost periphery of the second retreated portion B2, and the third retreated portion has a constant wall surface retreat amount in the spiral direction.

In addition, the wall surface retreat amount of the third retreated portion B3 may be set to zero so as to be the original wall surface profile.

A region from the involute starting point 3*b*7 to the innermost peripheral position 3*b*8 of the wall 3*b* becomes a region constituting a portion of the wall flat portion 3*b*2, and becomes a non-involute portion B4 which does not have the wall surface shape based on the involute curve. The non-involute region B4 is a region in which the wall surface does not come into contact with each other.

The wall surface retreat amount in each of the wall inclined connection portions 3*b*5 and 3*b*4 which connects the flat portion and the inclined portion to each other is set to be larger than the wall surface retreat amount in each of the retreated portions B1, B2, and B3.

Similarly to the above-described ventral side, the wall surface retreat amount is set to a dorsal side (outer peripheral surface side) of the wall 3*b* of the fixed scroll 3. That is, the different wall surface retreat amounts are set according to the regions corresponding to the wall flat portions 3*b*2 and 3*b*3 and the wall inclined portion 3*b*1. The wall surface retreat amount is also set for a ventral side and a dorsal side of the wall 5*b* of the orbiting scroll 5 based on the same way of thinking.

In this way, the wall surface retreat amounts are set to the ventral sides and the dorsal sides of the walls 3*b* and 5*b*, and thus, a desired mesh clearance is set.

In addition, it is not necessary to set the wall surface retreat amount to both the dorsal side and the ventral side in which the walls mesh with each other to face each other, and the wall surface retreat amount may be set to any one of the dorsal side and the ventral side so as to set a desired mesh clearance.

The above-described'scroll compressor 1 is operated as follows.

The orbiting scroll 5 performs the revolution orbiting movement around the fixed scroll 3 by a drive source such as an electric motor (not shown). Accordingly, the fluid is sucked from the outer peripheral sides of the respective scrolls 3 and 5, and the fluid is taken into the compression chambers surrounded by the respective walls 3*b* and 5*b* and the respective end plates 3*a* and 5*a*. The fluid in the compression chambers is sequentially compressed while being moved from the outer peripheral side toward the inner peripheral side, and finally, the compressed fluid is discharged from a discharge port 3*c* formed in the fixed scroll 3. When the fluid is compressed, the fluid is compressed in the height directions of the walls 3*b* and 5*b* in the inclined portions formed by the end plate inclined portions 3*a*1 and 5*a*1 and the wall inclined portions 3*b*1 and 5*b*1, and thus, the fluid is three-dimensionally compressed.

According to the present embodiment, the following operational effects are exerted.

However, when the fluid is compressed, a moment is applied to peripheries of the bases of the walls 3*b* and 5*b* by a load applied at the time of the tooth surface contact in which the walls 3*b* and 5*b* come into contact with each other in order to form the compression chamber. The moment in the peripheries of the bases of the walls 3*b* and 5*b* increases as the height of each wall increases. In addition, in ranges of the wall inclined portions 3*b*1 and 5*b*1, the heights of the walls 3*b* and 5*b* on the outer peripheral side are higher than those of the walls 3*b* and 5*b* on the inner peripheral side. Accordingly, in the mesh clearance which is the clearance between the walls 3*b* and 5*b* when the walls 3*b* and 5*b* mesh with each other, by appropriately setting the wall surface retreat amount, the mesh clearance on the outer peripheral side is larger than that on the inner peripheral side. Accordingly, it is possible to alleviate the moment applied to the peripheries of the bases of the walls 3*b* and 5*b* on the outer peripheral side each having a high wall height, and thus, bending stress can decrease.

In addition, even when the mesh clearance on the outer peripheral side is large, a pressure in the compression chamber on the outer peripheral side is lower than that on the inner peripheral side, and thus, influences of fluid leakage on performance decreases.

In the second retreated portion B2 corresponding to the wall inclined portions 3*b*1 and 5*b*1, the mesh clearance continuously or stepwise increases from the inner peripheral side to the outer peripheral side, and thus, it is possible to set the mesh clearance according to the wall height changed in the wall inclined portions 3*b*1 and 5*b*1. Accordingly, it is possible to suppress the bending stress generated in the bases of the walls 3*b* and 5*b* to a predetermined value or less.

Each of the wall inclined connection portions 3*b*4, 3*b*5, 5*b*4, and 5*b*5 which connect the wall flat portions 3*b*2, 3*b*3, 5*b*2, and 5*b*3 and the wall inclined portions 3*b*1 and 5*b*1 to each other is positioned at a position at which the shape of the wall is abruptly changed, and thus, it is difficult to increase processing accuracy, and there is a concern that a burr or the like occurs. Accordingly, there is a concern that an excessive tooth surface contact occurs in the wall inclined connection portions 3*b*4, 3*b*5, 5*b*4, and 5*b*5. Accordingly, the mesh clearance of each of the wall inclined connection portions 3*b*4, 3*b*5, 5*b*4, and 5*b*5 is set to be larger than the mesh clearances of other regions, that is, the mesh clearance of each of the wall flat portions 3*b*2, 3*b*3, 5*b*2, and 5*b*3 or each of the wall inclined portions 3*b*1 and 5*b*1. Accordingly, it is possible to avoid the excessive tooth surface contact in each of the wall inclined connection portions 3*b*4, 3*b*5, 5*b*4, and 5*b*5.

In addition, in the above-described embodiment, the predetermined wall surface retreat amount is set to the entirety of each of the wall inclined portions 3*b*1 and 5*b*1. However, the present invention is not limited to this. For example, with respect to the inner peripheral side of each of the wall inclined portions 3*b*1 and 5*b*1, the mesh clearance in which meshing with small fluid leakage is performed may be set to the original mesh clearance where the walls mesh with each other, and the mesh clearance which alleviates the tooth surface contact may be set on the outer peripheral side of each of the wall inclined portions 3*b*1 and 5*b*1. Accordingly, it is possible to alleviate the bending stress generated in the base of each of the walls 3*b* and 5*b* on the outer peripheral side while increasing compression performance on the inner peripheral side.

In addition, in the above-described embodiment, the end plate inclined portions 3*a*1 and 5*a*1 and the wall inclined portions 3*b*1 and 5*b*1 are provided on both scrolls 3 and 5. However, the end plate inclined portions 3*a*1 and 5*a*1 and the wall inclined portions 3*b*1 and 5*b*1 may be provided at any one of both scrolls 3 and 5.

Figure 9A:
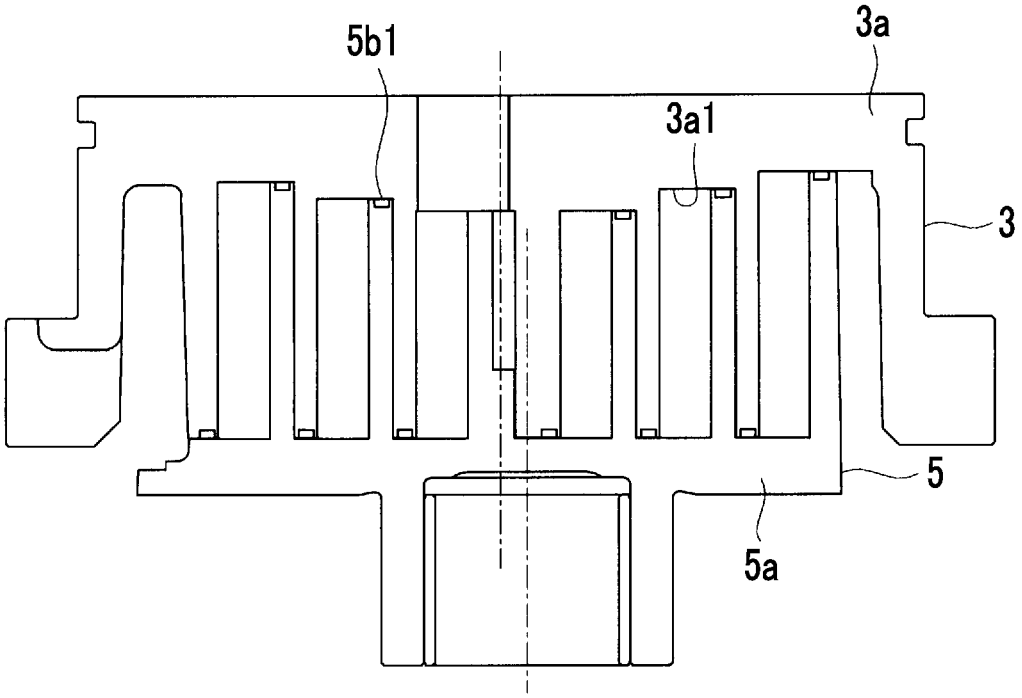
FIGS. 9A and 9B show a modification example.

Specifically, as shown in FIG. 9A, in a case where the wall inclined portion 5*b*1 is provided on the one wall (for example, orbiting scroll 5) and the end plate inclined portion 3*a*1 is provided on the other end plate 3*a*, the other wall and the one end plate 5*a* may be flat.

Figure 9B:
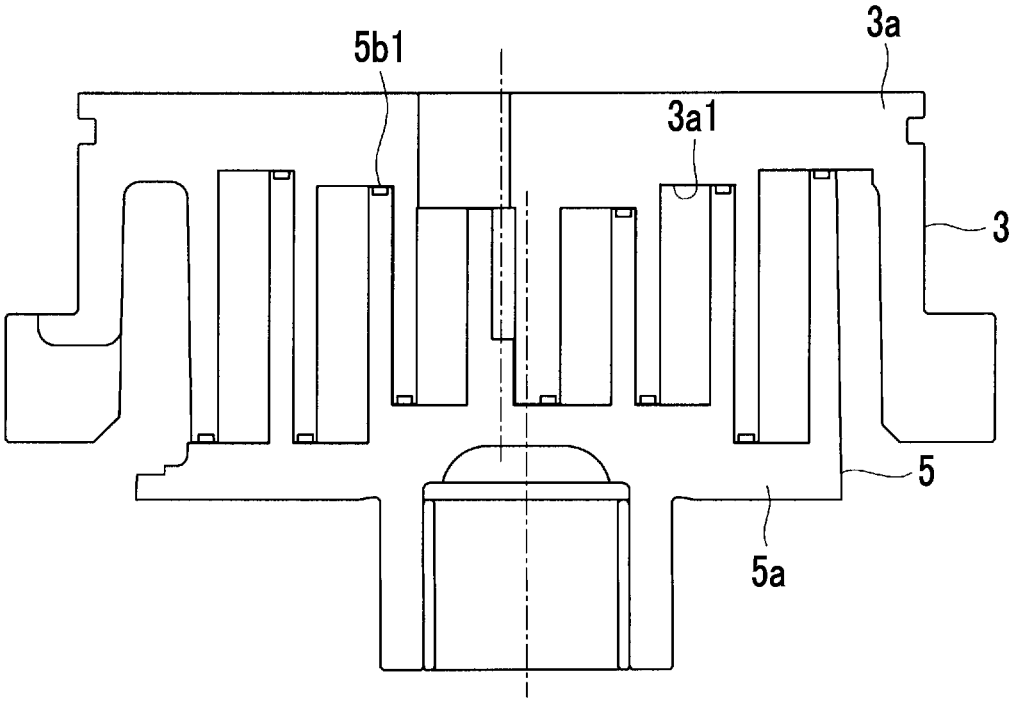

In addition, as shown in FIG. 9B, it may be combined with a stepped shape of the related art, that is, it may be combined with a shape in which a step portion is provided on the end plate 5*a* of the orbiting scroll 5 while the end plate inclined portion 3*a*1 is provided on the end plate 3*a* of the fixed scroll 3.

In the above-described embodiment, the wall flat portions 3*b*2, 3*b*3, 5*b*2, and 5*b*3 and the end plate flat portions 3*a*2, 3*a*3, 5*a*2, and 5*a*3 are provided. However, the flat portions on the inner peripheral side and/or the outer peripheral side may be omitted, and the inclined portion may be provided so as to extend to the entire walls 3*b* and 5*b*.

In the above-described embodiment, the scroll compressor is described. However, the present invention can be applied to a scroll expander which is used as an expander.

REFERENCE SIGNS LIST

1: scroll compressor (scroll fluid machine)
3: fixed scroll (first scroll member)
3*a*: end plate (first end plate)
3*a*1: end plate inclined portion
3*a*2: end plate flat portion (inner peripheral side)
3*a*3: end plate flat portion (outer peripheral side)
3*a*4: end plate inclined connection portion (inner peripheral side)
3*a*5: end plate inclined connection portion (outer peripheral side)
3*b*: wall (first wall)
3*b*1: wall inclined portion
3*b*2: wall flat portion (inner peripheral side)
3*b*3: wall flat portion (outer peripheral side)
3*b*4: wall inclined connection portion (inner peripheral side)
3*b*5: wall inclined connection portion (outer peripheral side)
3*b*6: outer peripheral end portion
3*b*7: involute starting point
3*b*8: innermost peripheral position
3*c*: discharge port
3*d*: tip seal groove
5: orbiting scroll (second scroll member)
5*a*: end plate (second end plate)
5*a*1: end plate inclined portion
5*a*2: end plate flat portion (inner peripheral side)
5*a*3: end plate flat portion (outer peripheral side)
5*a*4: end plate inclined connection portion (inner peripheral side)
5*a*5: end plate inclined connection portion (outer peripheral side)
5*b*: wall (second wall)
5*b*1: wall inclined portion
5*b*2: wall flat portion (inner peripheral side)
5*b*3: wall flat portion (outer peripheral side)
5*b*4: wall inclined connection portion (inner peripheral side)
5*b*5: wall inclined connection portion (outer peripheral side)
7: tip seal
B1: first retreated portion
B2: second retreated portion
B3: third retreated portion
B4: non-involute portion
Hc: height of tip seal
L: inter-facing surface distance
T: tip clearance
φ: inclination

The invention claimed is:

1. A scroll fluid machine comprising:

a first scroll member in which a spiral first wall is provided on a first end plate; and a second scroll member in which a spiral second wall is provided on a second end plate disposed to face the first end plate and the second wall meshes with the first wall such that the second scroll member performs a revolution orbiting movement relative to the first scroll member;

wherein the first end plate and the second end plate are provided with a first end plate inclined portion and a second end plate inclined portion in which an inter-facing surface distance between the first end plate and the second end plate facing each other monotonically and continuously decreases along spiral directions of the first wall and the second wall from outer peripheral sides in the spiral directions toward inner peripheral sides in the spiral directions, wherein the first wall and the second wall are provided with a first wall inclined portion and a second wall inclined portion which correspond to the first end plate inclined portion and the second end plate inclined portion, and wherein for a mesh clearance which is a clearance between the spiral first and second walls when the first wall and the second wall mesh with each other, the mesh clearance in the first wall inclined portion and the second wall inclined portion is larger on the outer peripheral sides in the spiral direction than on the inner peripheral sides in the spiral direction.

2. The scroll fluid machine according to claim 1, wherein the mesh clearance in the first wall inclined portion and the second wall inclined portion continuously or stepwise increases from the inner peripheral sides in the spiral direction to the outer peripheral sides in the spiral direction.

3. The scroll fluid machine according to claim 2, wherein the meshing clearance is increased by retreating a wall surface of at least one of the first wall or the second wall toward a center side in a thickness of the at least of the first wall or second wall from an original wall surface profile.

4. The scroll fluid machine according to claim 3, wherein a first wall flat portion having a height which is not changed is provided on at least one of outermost peripheral portion or innermost peripheral portion of the first wall, wherein a second wall flat portion having a height which is not changed is provided on at least one of outermost peripheral portion or innermost peripheral portion of the second wall, wherein a first end plate flat portion corresponding to the second wall flat portion is provided on the first end plate, wherein a second end plate flat portion corresponding to the first wall flat portion is provided on the second end plate, wherein a retreat amount of the first wall surface in a first wall inclined connection portion which connects the first wall flat portion and the first wall inclined portion to each other is larger than a retreat amount of the first wall surface provided in the first wall inclined portion and the first wall flat portion, and wherein a retreat amount of the second wall surface in a second wall inclined connection portion which connects the second wall flat portion and the second wall inclined portion to each other is larger than a retreat amount of the second wall surface provided in the second wall inclined portion and the second wall flat portion.

5. The scroll fluid machine according to claim 1, wherein the mesh clearance on the inner peripheral sides of the first wall inclined portion and the second wall inclined portion is an original mesh clearance where the walls mesh with each other.

6. The scroll fluid machine according to claim 5, wherein the meshing clearance is increased by retreating a wall surface of at least one of the first wall or the second wall toward a center side in a thickness of the at least of the first wall or second wall from an original wall surface profile.

7. The scroll fluid machine according to claim 6, wherein a first wall flat portion having a height which is not changed is provided on at least one of outermost peripheral portion or innermost peripheral portions of the first wall, wherein a second wall flat portion having a height which is not changed is provided on at least one of outermost peripheral portion or innermost peripheral portion of the second wall, wherein a first end plate flat portion corresponding to the second wall flat portion is provided on the first end plate, wherein a second end plate flat portion corresponding to the first wall flat portion is provided on the second end plate, wherein a retreat amount of the first wall surface in a first wall inclined connection portion which connects the first wall flat portion and the first wall inclined portion to each other is larger than a retreat amount of the first wall surface provided in the first wall inclined portion and the first wall flat portion, and wherein a retreat amount of the second wall surface in a second wall inclined connection portion which connects the second wall flat portion and the second wall inclined portion to each other is larger than a retreat amount of the second wall surface provided in the second wall inclined portion and the second wall flat portion.

8. The scroll fluid machine according to claim 1, wherein the meshing clearance is increased by retreating a wall surface of the first wall or the second wall toward a center side in a thickness of the at least of the first wall or second wall from an original wall surface profile.

9. The scroll fluid machine according to claim 8, wherein a first wall flat portion having a height which is not changed is provided on at least one of outermost peripheral portion or innermost peripheral portion of the first wall, wherein a second wall flat portion having a height which is not changed is provided on at least one of outermost peripheral portion or innermost peripheral portion of the second wall, wherein a first end plate flat portion corresponding to the second wall flat portion is provided on the first end plate, wherein a second end plate flat portion corresponding to the first wall flat portion is provided on the second end plate, wherein a retreat amount of the first wall surface in a first wall inclined connection portion which connects the first wall flat portion and the first wall inclined portion to each other is larger than a retreat amount of the first wall surface provided in the first wall inclined portion and the first wall flat portion, and wherein a retreat amount of the second wall surface in a second wall inclined connection portion which connects the second wall flat portion and the second wall inclined portion to each other is larger than a retreat amount of the second wall surface provided in the second wall inclined portion and the second wall flat portion.

* * * * *